US007034605B2

(12) United States Patent
Otsuka et al.

(10) Patent No.: US 7,034,605 B2
(45) Date of Patent: Apr. 25, 2006

(54) INTERNAL STEP-DOWN POWER SUPPLY CIRCUIT

(75) Inventors: Masayuki Otsuka, Tokyo (JP); Teruhiro Harada, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/028,065

(22) Filed: Jan. 4, 2005

(65) Prior Publication Data

US 2005/0151581 A1 Jul. 14, 2005

Related U.S. Application Data

(62) Division of application No. 10/845,215, filed on May 14, 2004, now Pat. No. 6,885,237, which is a division of application No. 10/243,644, filed on Sep. 16, 2002, now Pat. No. 6,753,721.

(30) Foreign Application Priority Data

Sep. 19, 2001 (JP) ..... 2001-285372

(51) Int. Cl.
*G05F 1/10* (2006.01)

(52) U.S. Cl. ..... 327/540

(58) Field of Classification Search ..... 327/530, 327/534, 535, 537, 538, 540, 541, 543, 561, 327/562, 563

See application file for complete search history.

(56) References Cited

U.S. PATENT DOCUMENTS 5,373,226 A * 12/1994 Kimura ..... 323/313
5,592,121 A * 1/1997 Jung et al. ..... 327/541
5,856,756 A 1/1999 Sasahara et al.
6,137,348 A 10/2000 Uchida et al.
6,218,893 B1 4/2001 Noguchi
6,300,810 B1 10/2001 Hardee
6,310,511 B1 * 10/2001 Weinfurtner ..... 327/540
6,313,694 B1 * 11/2001 Sohn ..... 327/541
6,501,303 B1 * 12/2002 Suyama ..... 327/81

FOREIGN PATENT DOCUMENTS

| | | |
|---|---|---|
| JP | 48-57629 | 7/1973 |
| JP | 02-059911 | 2/1990 |
| JP | 02-242309 | 9/1990 |
| JP | 04-067214 | 3/1992 |
| JP | 07-271455 | 10/1995 |
| JP | 09-172334 | 6/1997 |
| JP | 09-307368 | 11/1997 |
| JP | 11-119845 | 4/1999 |
| JP | 2001-117650 | 4/2001 |

* cited by examiner

*Primary Examiner*—Jeffrey Zweizig
(74) *Attorney, Agent, or Firm*—Volentine Francos & Whitt, PLLC

(57) ABSTRACT

An internal step-down power supply circuit has an internal step-down power-supply output node, a driver, a divider circuit and a current mirror circuit. The internal node provides an internal step-down power supply potential. The driver adjusts an external power-supply potential and provides an adjusted external power-supply potential to the internal node. The divider circuit divides a voltage that appears on the internal node and provides a divided voltage. The current mirror circuit is connected to the divider circuit. The current mirror circuit compares the voltage provided by the divider circuit and a reference voltage. The current mirror circuit sets the conductance of a first transistor feeding a current in response to the reference voltage to n times of the conductance of a second transistor feeding a current in response to the voltage provided from the divider circuit, wherein n is greater than 1.

19 Claims, 5 Drawing Sheets

INTERNAL STEP-DOWN POWER SUPPLY CIRCUIT

CROSS REFERENCE TO RELATED APPLICATIONS

This is a divisional application of application Ser. No. 10/845,215, filed May 14, 2004, now U.S. Pat. No. 6,885,237, which is a divisional application of Ser. No. 10/243,644, filed Sep. 16, 2002, now U.S. Pat. No. 6,753,721, which are hereby incorporated by reference in their entirety for all purposes.

BACKGROUND OF THE INVENTION

The present invention relates to an internal step-down power supply circuit suitable for use in a semiconductor device.

An internal step-down or deboost power supply circuit for generating an internal source or power-supply voltage by using an external power-supply voltage comprises a driver for supplying a source or power supply voltage, a divider circuit for dividing the internal power-supply voltage, an amplifier for comparing the voltage generated from the divider circuit and a reference voltage and supplying a drive voltage to the driver based on the result of comparison, etc.

Now, the more a circuit connected to a terminal for outputting an internal power-supply potential in the internal step-down power supply circuit increases in size, the more source impedance must be reduced. Thus, the size of a transistor for the driver becomes very large in a VLSI in which a stepped-down or deboosted power supply produced in the internal step-down power supply circuit is used in the whole semiconductor chip, thereby increasing load capacity of the amplifier. However, a change in instantaneous current of the circuit connected to the terminal for outputting the internal power-supply potential results in such very large values as to rise in one stroke from a value near zero to a few 10 mA even in the case of a small current and a few 100 mA in the case of a large current. On the other hand, since the current that the amplifier can feed, is limited in terms of specs, various methods used up to now could not achieve compatibility with a follow-up to a change in internal step-down power-supply potential.

SUMMARY OF THE INVENTION

An object of the present invention is to provide an internal step-down power supply circuit having a capability of improving response performance (transition from a standby state to an active state in particular) of a system without increasing current consumption.

An internal step-down power supply circuit of the present invention has an internal step-down power-supply output node, a driver, a divider circuit and a current mirror circuit. The internal node provides an internal step-down power supply potential. The driver adjusts an external power-supply potential and provides an adjusted external power-supply potential to the internal node. The divider circuit divides a voltage that appears on the internal node and provides a divided voltage. The current mirror circuit is connected to the divider circuit. The current mirror circuit compares the voltage provided by the divider circuit and a reference voltage. The current mirror circuit sets the conductance of a first transistor feeding a current in response to the reference voltage to n times of the conductance of a second transistor feeding a current in response to the voltage provided from the divider circuit, wherein n is greater than 1.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

Preferred embodiments of the present invention will hereinafter be described in detail with reference to the accompanying drawings.

Figure 1:
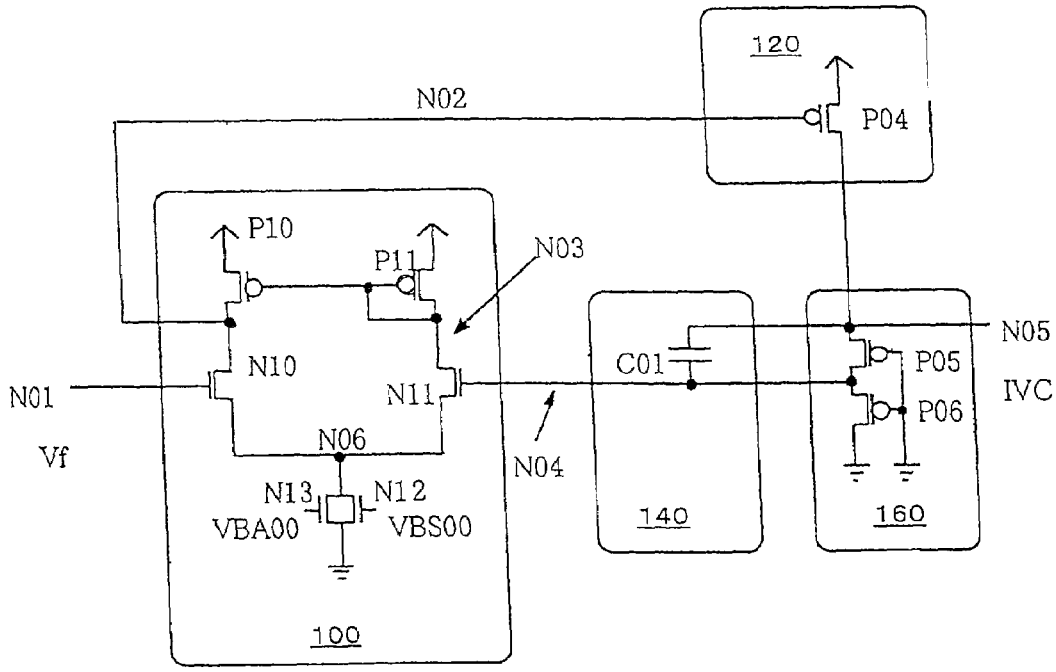
FIG. 1 is a circuit diagram showing a first embodiment of an internal step-down power supply circuit of the present invention.

FIG. 1 is a circuit diagram showing a first embodiment of an internal step-down power supply circuit of the present invention. In the present specification unless otherwise stated below, VDD indicates an external source or power supply voltage, IVC indicates an internal source or power-supply voltage indicative of a potential level lower than the level of the external power supply voltage VDD, "H" indicates an external source or power supply voltage level, "L" indicates a ground level, "VF" indicates a reference potential, and "VB" indicates a current control voltage for a differential amplifier, respectively. Further, NMOSs are signs indicative of N channel MOS transistors, PMOSs are signs indicative of P channel MOS transistors, CAPs are signs indicative of capacitors, INVs are signs indicative of inverters, respectively.

The internal step-down power supply circuit shown in FIG. 1, according to the first embodiment of the present invention comprises a differential amplifier 100, a driver 120, a speed-up capacitor 140 (C01) and a divider circuit 160. The differential amplifier 100 is an amplifier circuit that amplifies the difference between right-and-left input potentials and outputs it therefrom. The speed-up capacitor 14 is a capacitor for instantaneously transferring a change in internal power-supply voltage to an input part of the differential amplifier 100. The driver 120 comprises a transistor P04 for supplying a current from the external power supply VDD to the internal step-down power supply IVC. The divider circuit 160 is a circuit for generating a voltage divided from a constant voltage.

In FIG. 1, P00 through P06 indicate PMOSs respectively. Further, N10 through N13 indicate NMOSs respectively. A signal VBA00 is a signal brought to "H" in an active state and brought to "L" upon standby. A terminal VBS00 is used to supply a low voltage "VB". A node N05 corresponds to an output terminal used to output the internal step-down power supply IVC.

A gate electrode of the NMOS N10 is electrically connected to a node N01 corresponding to one signal input terminal of the differential amplifier 100. First electrodes of PMOSs P10 and P11 are electrically connected to the external power supply potential VDD. A gate electrode of the PMOS P10, a gate electrode and the other electrode of the PMOS P11, and the other electrode of an NMOS N11 are electrically connected to a node N03. The other electrode of the PMOS P10 and the other electrode of an NMOS N10 are electrically connected to a node N02. The first electrode of the NMOS N10, the first electrode of the NMOS N11, the first electrode of the NMOS N12, and the first electrode of the NMOS N13 are electrically connected to a node N06. A gate electrode of the NMOS N12 is electrically connected to the terminal VBS00, whereas the other electrode thereof is electrically connected to a ground potential GND. A gate electrode of the NMOS N13 is supplied with the signal VBA00, and the other electrode thereof is electrically connected to the ground potential GND.

Now, the NMOS N11 and the PMOS P11 of the differential amplifier 100 make use of transistors low in conductance. The ratio between the conductance of the PMOS P10 and that of the NMOS N10, and the ratio between the conductance of the PMOS P11 and that of the NMOS N11 are equally set. The ratios determine the gain of the differential amplifier 100. The NMOS N10 and the PMOS P10 are respectively set to conductances equivalent to n times those of the NMOS N11 and PMOS P11. Although the more n increases, the more the effect is brought about, the intended or objective one can be achieved if more than or equal to twice. If preferably four times or more are given, then the effect becomes pronounced as will be described below.

The driver 140 comprises the PMOS P04. One electrode of the PMOS P04 is electrically connected to the external power supply potential VDD, the other electrode thereof is electrically connected to the node N05 (output terminal of internal power-supply voltage IVC), and a gate electrode thereof is electrically connected to the output node N02 of the differential amplifier 100.

The speed-up capacitor 140 (C01) is electrically connected between a node N04 electrically connected to the gate electrode of the NMOS N11, which corresponds to the other input of the differential amplifier 100, and the node N05.

The divider circuit 160 comprises the two PMOSs P05 and P06. One electrode of the PMOS P05 is electrically connected to the node N05, whereas the other electrode thereof is electrically connected to the node N04 and one electrode of the PMOS P06. A gate electrode of PMOS P05 is electrically tied to the ground potential GND in common with the gate electrode and other electrode of the PMOS P06.

The operation of the internal step-down power supply circuit according to the first embodiment of the present invention will next be described.

The differential amplifier 100 is a circuit that outputs the difference between the right and left input signals as its amplified potential difference. In the present circuit, a voltage Vf at one input node N01 is set as a reference voltage. The difference between the voltage Vf and a potential or voltage at the other input node N04 is amplified to a potential difference equivalent to twice the gain with respect to the node N03 and then outputted to the output node N02. Let's now assume that the ratio between the conductances of the PMOSs P10 and P11 (i.e., NMOSs N10 and N11) is defined as 4:1 and a current that flows through the whole differential amplifier 100, is defined as 5 mA. A current that flows through the PMOS P11 and the NMOS N11, is 1 mA, and a current that flows through the PMOS P10 and the NMOS N10, is 4 mA. Accordingly, the output node N02 is driven by the current of 4 mA.

If the ratio between the conductance of the PMOS P10 (i.e., NMOS N10) and that of the PMOS P11 (i.e., NMOS N11) is assumed to be 1:1, then the current that flows through the PMOS P11 and the NMOS N11, is 2.5 mA, and the current that flows through the PMOS P10 and the NMOS N10, is 2.5 mA. Thus, the output node N02 is driven by the current of 2.5 mA. Namely, the driver 120 can be early driven by a change in conductance ratio.

The PMOS P04 of the driver 120 supplies a current corresponding to the voltage at the node N02 to the node N05. The divider circuit 160 divides the potential at the node N05 to a predetermined division ratio and outputs it to the other input node N04 of the differential amplifier 100. Since the potential at the node N04 reaches "internal power-supply voltage IVC×(2/3)=Vf" when the ratio between ON resistances of the PMOSs P05 and P06 corresponding to a pair of division ratio setting element groups, for example, is given as 1:2, the internal power-supply voltage IVC=1.5×Vf. The PMOS P04 and the differential amplifier 100 are respectively set to drive capabilities commensurate with an instantaneous current and a stationary current consumed by a circuit (hereinafter called an "internal power-supply voltage slave circuit") connected to the output node N05. Thus, the differential amplifier 100, the driver 120 and the divider circuit 160 constitute a negative feedback circuit, which is capable of obtaining a step-down voltage corresponding to the reference voltage Vf and the division ratio of the divider circuit 160. Incidentally, the speed-up capacitor performs the action of instantaneously transferring a change in the potential at the node N05 to the node N04 and increasing a response speed of a feedback system.

Incidentally, since power consumption is low in a standby state, the signal VBA00 is rendered "L" and the NMOS N13 is held OFF. The low voltage VB is always applied to the terminal VBS00 and the NMOS N12 feeds a small current alone. Since only the small current allowed flowing by the NMOS N12 flows through the differential amplifier 100, a response speed is extremely reduced. Since, however, the instantaneous current of the internal power-supply voltage slave circuit is not developed in the standby state, the potential of the internal power-supply voltage can be maintained.

On the other hand, the signal VBA00 results in "H" in an active state. A current enough to allow the PMOS P04 to instantaneously respond to the instantaneous current that flows out from the node N05 and maintain the internal power-supply voltage, flows through the NMOS N13 that constitutes the differential amplifier 100. Therefore, even if the instantaneous current of the internal power-supply voltage slave circuit varies in a steady state, the system is capable of suppressing a variation in the potential of the internal power-supply voltage.

According to the first embodiment of the present invention as described above, since the drive capability of the driver can be enhanced under the same current consumption and exclusively-possessed or occupied area, it is possible to lighten a reduction in the potential of the internal power-supply voltage due to the instantaneous current of the internal power-supply voltage slave circuit.

With a decrease in the size of the NMOS N11 as compared with the NMOS N10, the node N04 is reduced in parasitic capacitance too. Therefore, an advantageous effect is also brought about in that the speed-up capacitor C01 can be made smaller than ever and the efficiency of transfer of the change in voltage from the node N05 increases.

Figure 2:
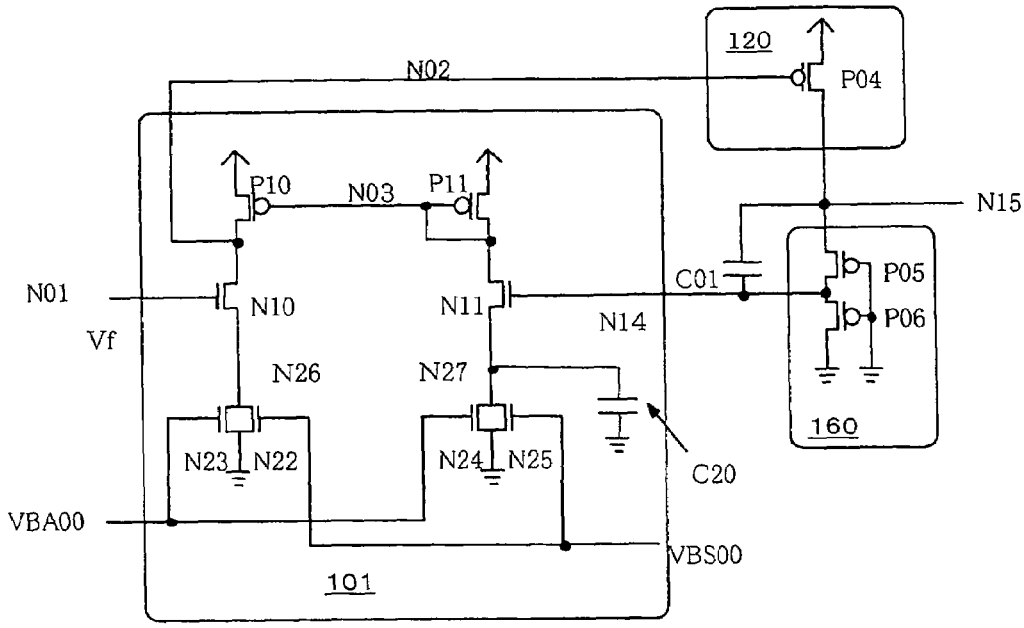
FIG. 2 is a circuit diagram illustrating a second embodiment of an internal step-down power supply circuit of the present invention.

FIG. 2 is a circuit diagram showing an internal step-down power supply circuit according to a second embodiment of the present invention. Incidentally, the same elements of structure as those in FIG. 1 are respectively identified by the same reference numerals in FIG. 2 and the description thereof will therefore be omitted.

Since the second embodiment is different from FIG. 1 in terms of a configuration of a differential amplifier 101, a description will be made of that portion alone.

The differential amplifier 101 comprises PMOSs P10 and P11, NMOSs N10, N11 and N22 through N25, and a stabilizing capacitor C20. In the differential amplifier 101, one electrode of the NMOS N10 is electrically connected to a node N02, the other electrode thereof is electrically connected to a node N26, and a gate electrode thereof is electrically connected to a node N01, respectively. One electrode of the NMOS N11 is electrically connected to a node N03, the other electrode thereof is electrically connected to a node N27, a gate electrode thereof is electrically connected to a node N14, respectively. One electrode of the NMOS N23 is electrically connected to a node N26, the other electrode thereof is electrically connected to a ground potential GND, and a gate electrode thereof is supplied with a signal VBA00, respectively. One electrode of an NMOS N22 is electrically connected to the node N26, the other electrode thereof is electrically connected to the ground potential GND, and a gate electrode thereof is electrically connected to a terminal VBS00, respectively. One electrode of the NMOS N24 is electrically connected to the node N27, the other electrode thereof is electrically connected to the ground potential GND, and a gate electrode thereof is supplied with the signal VBA00, respectively. One electrode of the NMOS N25 is electrically connected to the node N27, the other electrode thereof is electrically connected to the ground potential GND, and a gate electrode thereof is electrically connected to the terminal VBS00, respectively. The stabilizing capacitor C20 is electrically connected between the node N27 and GND.

The ratio of the conductance of the NMOS N23 to that of the NMOS N24 is set equal to the ratio between the conductance of the PMOS P10 and that of the PMOS P11 employed in the first embodiment. Further, the ratio between the conductance of the NMOS N22 and that of the NMOS N25 is also set to become similar to the ratio between the conductance of the NMOS N23 and that of the NMOS N24.

The operation of the internal step-down power supply circuit according to the second embodiment of the present invention will next be described with reference to FIG. 2.

A current that flows through an internal power-supply voltage slave circuit, is 0 in a standby state. The NMOSs N22 and N25 connected to the terminal VBS00 simply feed a small current. The PMOSs P11, P10 and the NMOSs N10 and N11 that constitute the differential amplifier 101, are respectively in a state of being slightly ON. Similarly, a PMOS P04 of a driver 120 is also in a state of being slightly ON, which is indicative of only the supply of a current used up or consumed by a divider circuit. The differential amplifier 101 serves as a current mirror similar to the differential amplifier 100. In a manner similar to the first embodiment upon standby, the other input voltage converges on a predetermined step-down or deboost voltage with one input voltage Vf as a reference voltage.

On the other hand, the signal VBA00 is brought to "H" in an active state and hence the NMOSs N23 and N24 each of which receives the signal therein as an input, are turned ON. Therefore, although there is a difference in that current consumption increases as compared with the standby state, the step-down voltage in the steady state is basically identical to that in the first embodiment.

A change from the standby state to the active state will next be described.

Voltages applied to the gates of the NMOSs N10 and N11 in a state of equilibrium remain unchanged upon both the standby and active states. Thus, each of the nodes N26 and N27 is brought to a slightly high voltage by current suppression upon standby as compared with upon the active state. Since the individual internal power-supply voltage slave circuits are operated in unison and starts to feed a large instantaneous current upon transition from this state to the active state, the output is temporarily reduced. While the node N26 is reduced in one stroke in potential by the turning ON of the NMOSs N23 and N24 in the differential amplifier 101, the node N27 is slowly lowered in potential since time is required to discharge the stabilizing capacitor C20. Accordingly, a reduction in the potential at the node N03 is low by a gradual amount of reduction in the potential at the node N27, and the supply of the current to the PMOSs P10 and P11 still remains small. Thus, the NMOS N10 at the time that the node N26 is lowered in one stroke in potential, is sharply turned ON and only the node N02 is quickly reduced in potential. Since the PMOS P04 of the driver is brought to a state of being capable of supplying a large current instantaneously, the internal power-supply voltage is capable of lightening a potential reduction and providing quick restoration.

According to the second embodiment of the present invention as described above, since the driver is immediately brought to the ON state upon transition from the standby state to the active state, the reduction in the potential of the internal step-down power supply due to the instantaneous current that flows out from the output, can be lightened and the restoration can be speeded up.

Figure 3:
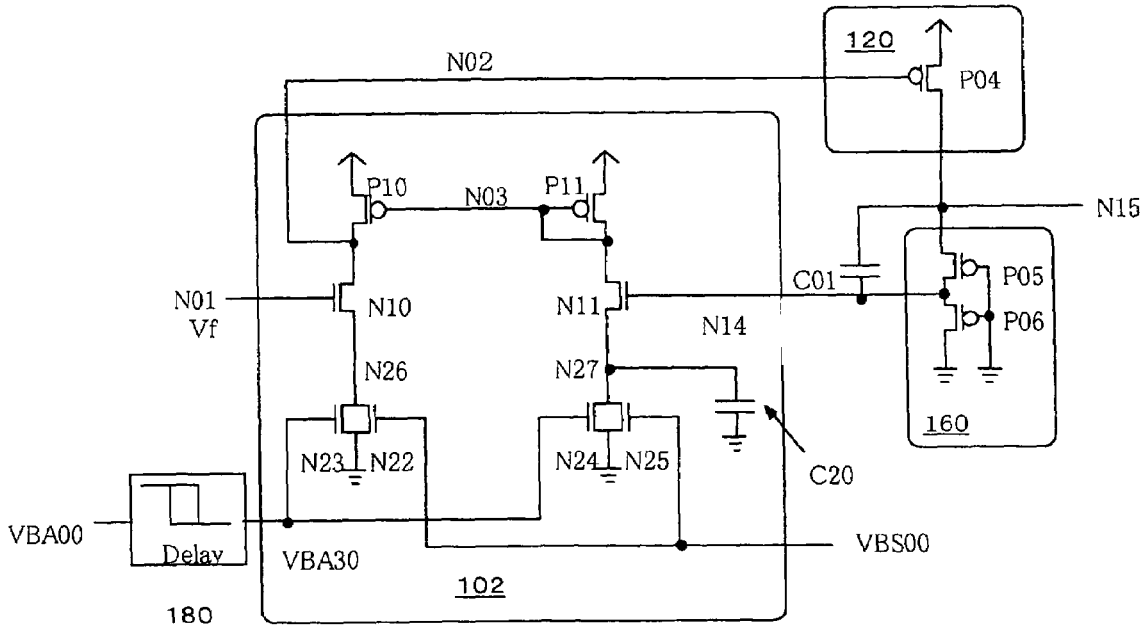
FIG. 3 is a circuit diagram depicting a third embodiment of an internal step-down power supply circuit of the present invention.

FIG. 3 is a circuit diagram showing an internal step-down power supply circuit according to a third embodiment of the present invention. Incidentally, the same components as those shown in FIG. 2 are respectively identified by the same reference numerals in FIG. 3, and the description thereof will therefore be omitted.

The third embodiment is different in timing provided to input the signal VBA00 shown in FIG. 3. Namely, the third embodiment is provided with a delay circuit 180 for delaying the differential amplifier 102 employed in the second embodiment from a standby state. Hence only portions associated with it will be described.

In a differential amplifier 102, gate electrodes of NMOSs N23 and N24 are respectively electrically connected to a node VBA30. The node VBA30 receives a signal VBA00 through the delay circuit 180 in such a manner that the signal VBA00 is delayed by a time required to completely bring an internal step-down power-supply slave circuit to the standby state upon only the falling edge of the signal VBA00. Incidentally, when the signal VBA00 rises, its timing is the same.

The operation of the internal step-down power supply circuit according to the third embodiment of the present invention will next be described with reference to FIG. 3.

Operations in the standby state, the active state and at the transition from the standby state to the active state are identical to the second embodiment and the description thereof will therefore be omitted.

Even upon the transition from the active state to the standby state in a manner similar to the transition from the standby state to the active state, the internal step-down power-supply slave circuit is rendered inactive and hence a large change in instantaneous current takes place. Thus, a problem arises in that when the step-down power-supply circuit is immediately brought to the standby state while the internal step-down power-supply slave circuit is not rendered inactive, a step-down power-supply voltage cannot maintain a predetermined voltage with respect to a subsequent change in instantaneous current. Therefore, the third embodiment is provided with the delay circuit 180 having a delay equivalent to the time required to completely bring the internal step-down power-supply slave circuit into inactivity according to the signal VBA00 upon transition from the active state to the standby state. Thus, the step-down circuit is also brought to the active state while the internal step-down power-supply slave circuit is in operation, whereas the step-down circuit is brought to the standby state in a state in which the internal step-down power-supply slave circuit stops operating and no instantaneous current flows.

According to the third embodiment of the present invention as described above, since there is provided the delay circuit 180 for providing the delay equivalent to the time required to completely bring the internal step-down power-supply slave circuit to the non-activity according to the signal VBA00, the step-down power-supply voltage can be maintained at a predetermined voltage even upon the transition from the active state to the standby state.

Figure 4:
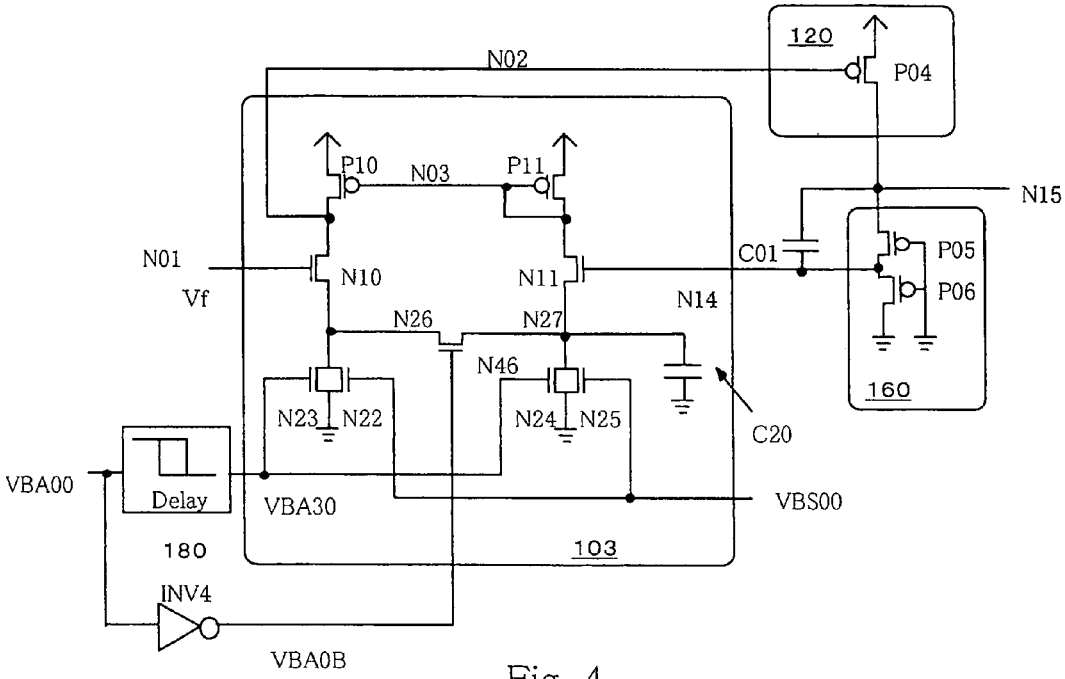
FIG. 4 is a circuit diagram showing a fourth embodiment of an internal step-down power supply circuit of the present invention.

FIG. 4 is a circuit diagram showing an internal step-down power supply circuit according to a fourth embodiment of the present invention. Incidentally, the same components as those in FIG. 3 are respectively identified by the same reference numerals in FIG. 4 and the description thereof will therefore be omitted.

In the fourth embodiment, a differential amplifier 103 is provided as a modification wherein an NMOS N46 for equalizing voltages at nodes N26 and N27 upon standby is added to the differential amplifier 102 employed in the third embodiment. Further, there is provided a circuit (inverter INV4) for generating a signal VBA0B for controlling the NMOS N46. These portions different in configuration from the third embodiment will be described below.

Since the control signal VBA0B is of a phase-inverted signal of a signal VBA00, the inverter INV4 uses a signal VBA as an input signal. In the differential amplifier 103, one electrode of the NMOS N46 is electrically connected to a node N26, the other electrode thereof is electrically connected to a node N27, and a gate electrode thereof is electrically connected to the output of the inverter INV4 respectively. The NMOS N46 has an ON resistance equivalent to the extent negligible for ON resistances of the NMOSs N23 and N24.

The operation of the fourth embodiment of the present invention will next be described using FIG. 4 in terms of only the added circuit portion.

Since the signal VBA0B is "L" and the NMOS N46 is held OFF in an active state, the operation thereof is identical to the third embodiment.

Since the signal VBA0B takes "L" of a signal VBA00 and is then brought to "H" in a standby state, the NMOS N46 is turned ON. Namely, the potentials at the node N26 and the node N27 are equalized.

According to the fourth embodiment of the present invention as described above, the equalization of the potentials at the nodes N26 and N27 makes it possible to bring the step-down power-supply voltage at standby to a set value without being so affected by transistor manufacturing variations.

Since it is necessary to reduce current consumption at standby as less as possible, currents consumed at the NMOSs N23 and N24 are extremely low. When these currents are reduced to a sub-threshold current, there is a danger that the step-down power-supply voltage at standby deviates from the set voltage due to variations in the manufacture of the NMOSs N23 and N24 that constitute the differential amplifier. According to the fourth embodiment, since the nodes N26 and N27 are equalized in potential, low current consumption can be achieved without being subjected to the variations in the manufacture of the NMOSs N23 and N24.

Figure 5:
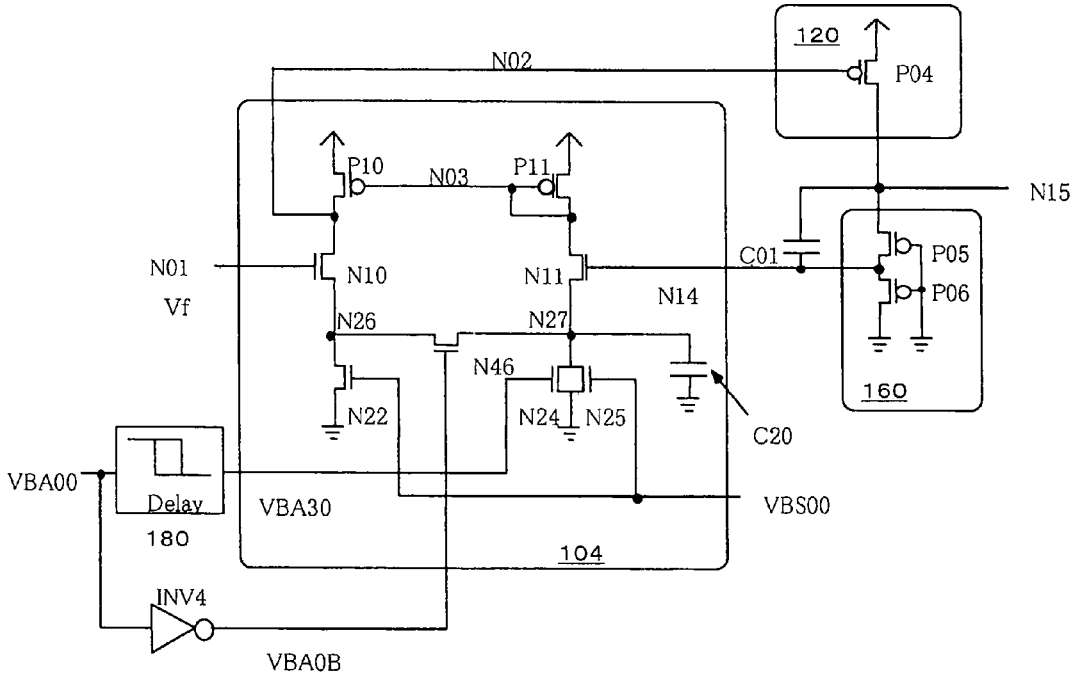
FIG. 5 is a circuit diagram depicting a fifth embodiment of an internal step-down power supply circuit of the present invention.

FIG. 5 is a circuit diagram showing an internal step-down power supply circuit according to a fifth embodiment of the present invention. Incidentally, the same components as those in FIG. 4 are respectively identified by the same reference numerals in FIG. 5 and the description thereof will therefore be omitted.

The fifth embodiment makes use of a differential amplifier 107 from which the NMOS N23 provided for the differential amplifier 106 employed in the fourth embodiment is deleted.

The operation of the fifth embodiment of the present invention will next be described using FIG. 6 in terms of only the portion different from the fourth embodiment.

A signal VBA0B is "L" and an NMOS N46 is held OFF in an active state. While the NMOS N23 has been deleted, a current that flows through an NMOS N23, can be neglected because the current is less reduced by double to triple digits as compared with a current that flows through an NMOS N22. Therefore, the operation of the fifth embodiment at the active state is considered to be identical to the third and fourth embodiments.

Since the signal VBA0B takes "L" of a signal VBA00 and is brought to "H" in a standby state, the NMOS N46 is turned ON. Accordingly, an ON resistance of the NMOS N46 is negligibly smaller than that of the NMOS N23, potentials at nodes N26 and N27 are equalized in a manner similar to the fourth embodiment.

According to the fifth embodiment of the present invention as described above, a step-down power-supply voltage at standby can be brought to a set voltage owing to the equalization of the potentials at the nodes N26 and N27 in the same manner as the fourth embodiment.

In the fifth embodiment, a chip area equivalent to the deleted area of NMOS N23 can be reduced as compared with the fourth embodiment. Further, current consumption can also be reduced.

Incidentally, while the NMOS N23 has been deleted and the NMOS N24 has been left behind in the fifth embodiment, the inverse thereof is also made possible.

Figure 6:
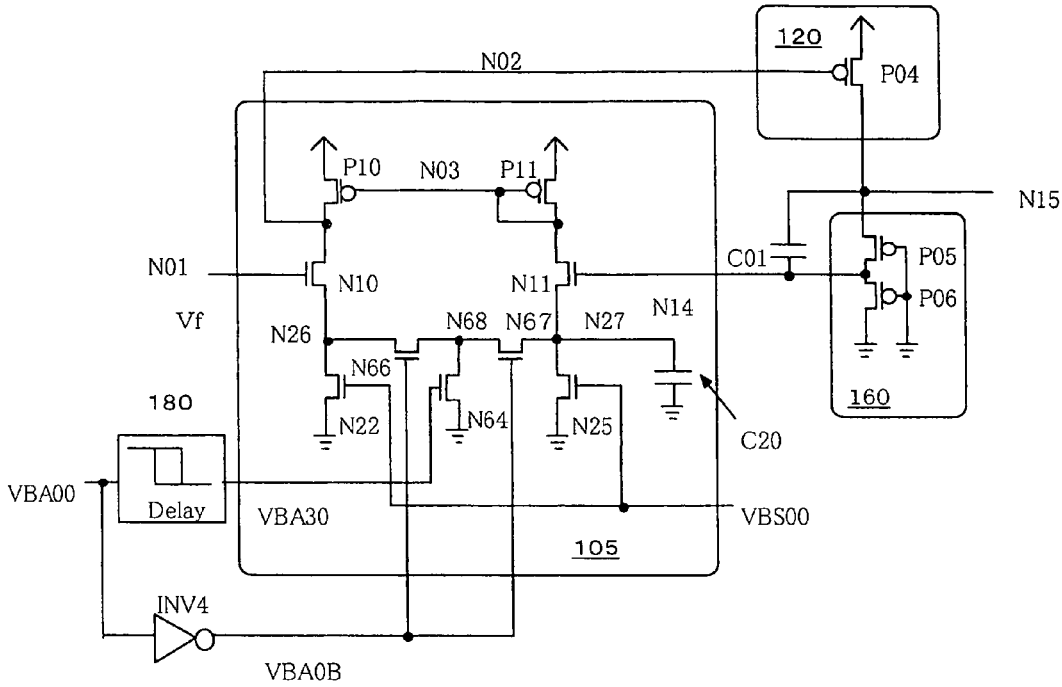
FIG. 6 is a circuit diagram illustrating a sixth embodiment of an internal step-down power supply circuit of the present invention.

FIG. 6 is a circuit diagram showing an internal step-down power supply circuit according to a sixth embodiment of the present invention. Incidentally, the same components as those in FIG. 5 are respectively identified by the same reference numerals in FIG. 6 and the description thereof will therefore be omitted.

The sixth embodiment makes use of a differential amplifier 105 wherein in the differential amplifier 104 employed in the fifth embodiment, the NMOS N46 for equalizing the voltages at the nodes N26 and N27 at standby is changed to two series-connected NMOSs N66 and N67, and an NMOS N64 for bringing an intermediate node N68 between the two NMOSs N67 and N68 down to a ground potential is provided as an alternative to the NMOS N46. Only these portions different in configuration from the fifth embodiment will be explained below.

One electrode of the NMOS N66 is electrically connected to the node N26, the other electrode thereof is electrically connected to the node N68, and a gate electrode thereof is supplied with a signal VBA0B, respectively. One electrode of the NMOS N67 is electrically connected to the node N27, the other electrode thereof is electrically connected to the node N68, and a gate electrode thereof is supplied with the signal VBA0B, respectively. One electrode of the NMOS N64 is electrically connected to the node N68, the other electrode thereof is electrically connected to the ground potential GND, and a gate electrode thereof is electrically connected to a node VBA30 (output of a delay 180), respectively.

Incidentally, ON resistances of the NMOSs N66 and N67 are negligibly smaller than an ON resistance of the NMOS N64. When it is desired to follow up the extreme strictness about the voltage, the ratio between the conductance of the NMOS N66 and that of the NMOS N67 is matched with the ratio between the conductance of the PMOS P10 and that of the PMOS P11.

The operation of the sixth embodiment of the present invention will be described using FIG. 6 in terms of the portions different from the fifth embodiment.

The signal VBA0B is "L" and the NMOSs N66 and N67 are held OFF in an active state. Since the NMOS N24 is omitted, an active current for the differential amplifier 105 flows through the NMOSs N22 and N25 alone. The current that flows through the NMOS N23 deleted from the fifth embodiment, is negligible because it is reduced by double or triple digits as compared with the current that flows through each of the NMOSs N22 and N25. Therefore the operation of the sixth embodiment in the active state may be considered to be identical to the third through fifth embodiments.

Since the voltage applied to the gate of the NMOS N64 is low, the NMOS N64 is always held ON. Since the signal VBA0B takes L" of a signal VBA00 and is brought to "H" in a standby state, the NMOSs N66 and N67 are held ON. Since ON resistances of the NMOSs N66 and N67 are negligibly smaller than the ON resistance of the NMOS N64 (or it is matched with a conductance ratio between the right and left transistors that constitute the differential amplifier 105), potentials at the nodes N26 and N27 are completely equalized.

According to the sixth embodiment of the present invention as described above, economizing current consumption is achieved and a step-down power-supply voltage at standby is provided as a set voltage owing to the complete equalization of the potentials at the nodes N26 and N27. Thus, they can be compatible with each other within a wide power-supply potential range.

Figure 7:
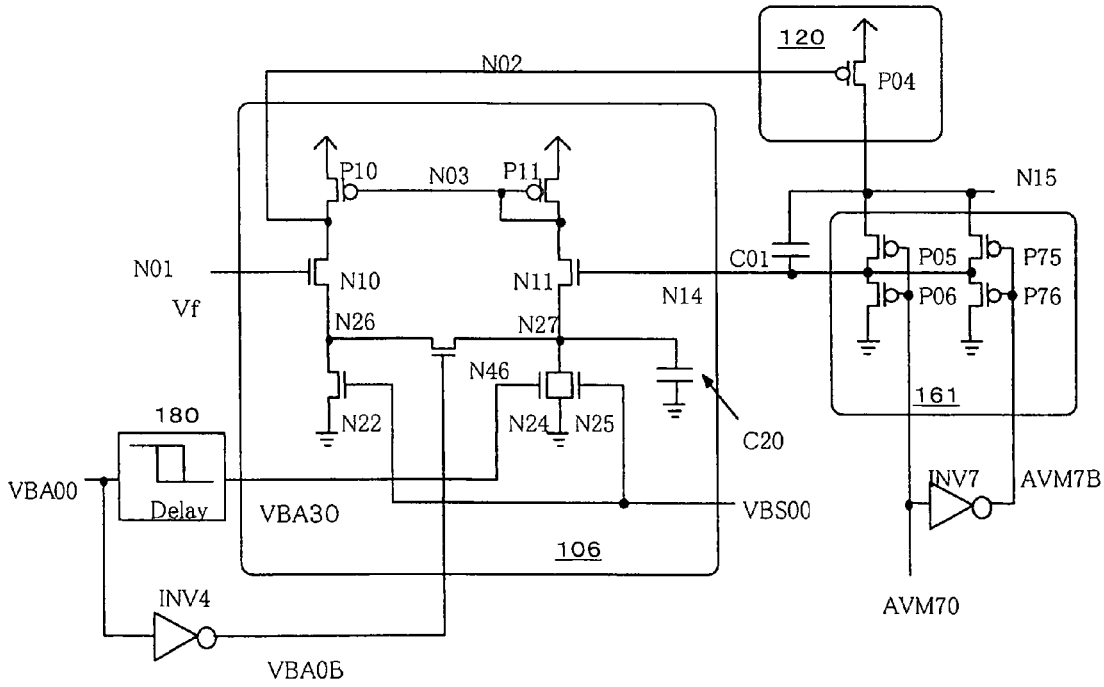
FIG. 7 is a circuit diagram showing a seventh embodiment of an internal step-down power supply circuit of the present invention.

FIG. 7 is a circuit diagram showing an internal step-down power supply circuit according to a seventh embodiment of the present invention. Incidentally, the same components as those in FIG. 6 are respectively identified by the same reference numerals in FIG. 7 and the description thereof will therefore be omitted.

The seventh embodiment is an example wherein the divider circuit 160 employed in the fifth embodiment is modified to provide a divider circuit 161. Since others are identical to FIG. 7 except for the divider circuit 161, the configuration of the divider circuit 161 will be explained.

A signal AVM70 is a control signal for performing switching to a step-down power-supply voltage according to device's operation modes. An inverter INV7 receives the signal AVM70 therein and outputs a phase-inverted signal AVM7B thereof therefrom.

In the divider circuit 161, one electrode of a PMOS P05 is electrically connected to a node N15, the other electrode thereof is electrically connected to a node N14, and a gate electrode thereof is supplied with the control signal AVM70, respectively. One electrode of a PMOS P06 is electrically connected to a node N14, the other electrode thereof is electrically connected to a ground potential GND, and a gate electrode thereof is supplied with the control signal AVM70, respectively. One electrode of a PMOS P75 is electrically connected to the node N15, the other electrode thereof is electrically connected to the node N14, and a gate electrode thereof is supplied with the control signal AVM7B, respectively. One electrode of a PMOS P76 is electrically connected to the node N14, the other electrode thereof is electrically connected to the ground potential GND, and a gate electrode thereof is supplied with the control signal AVM7B, respectively. The ratio between ON resistances of the PMOSs P75 and P76 is set to a ratio different from the ratio between ON resistances of the PMOSs P05 and P06.

The operation of the seventh embodiment of the present invention will be described using FIG. 8 from only a phase at operation mode switching different from the fifth embodiment.

When the signal AVM70 is "L", the PMOSs P05 and P06 in the divider circuit 161 are operated and the PMOSs P75 and P76 are not operated. Thus, the operation of the seventh embodiment is completely the same as the operations described up to now, which is defined as a normal operation. Upon the normal operation, the step-down power-supply voltage is given as 1.5×Vf as described above.

On the other hand, when the signal AVM70 reaches "H", the signal AVM7B results in "L". Thus, the PMOSs P05 and P06 in the divider circuit 161 are turned OFF, and the PMOSs P75 and P76 thereof are turned ON. Accordingly, a division ratio determined by a division ratio setting element group of the PMOSs P75 and P76 is outputted to the node N14. When the ratio between the ON resistances of the PMOSs P75 and P76 is set as 1:1, for example, the step-down power-supply voltage results in 2×Vf.

According to the seventh embodiment of the present invention as described above, the step-down power-supply voltage can be selected according to the operation modes. According to the present embodiment, the step-down power-supply voltage is lowered in a low frequency operation mode, for example, and hence lower current consumption can also be realized.

Figure 8:
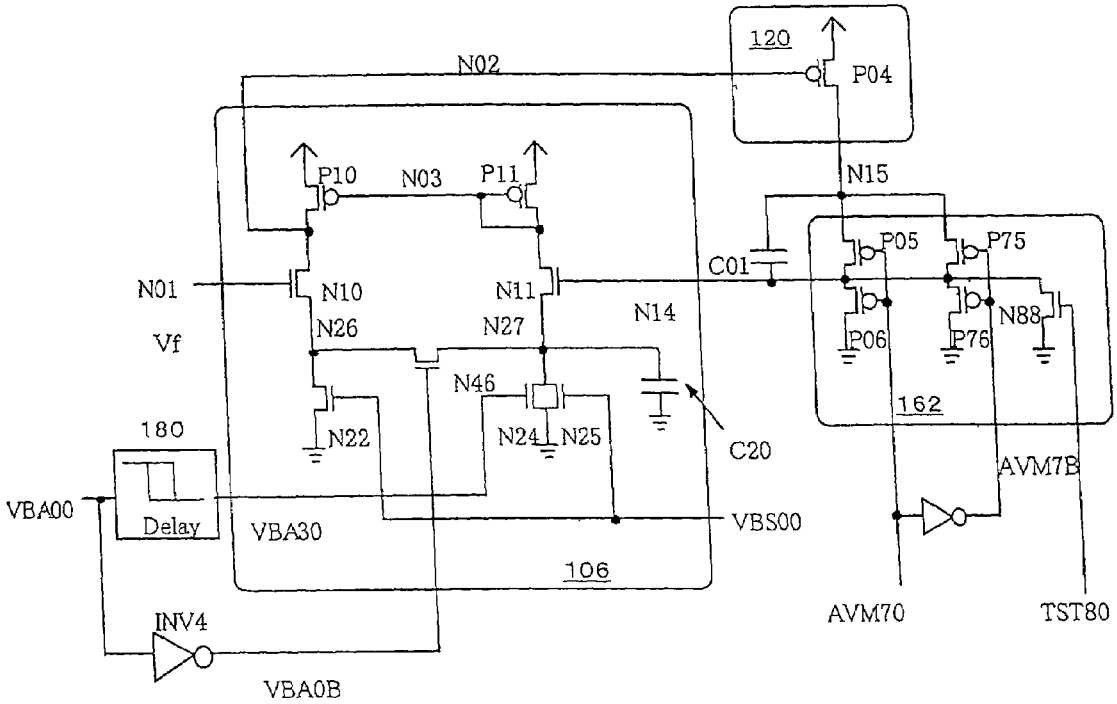
FIG. 8 is a circuit diagram depicting an eighth embodiment of an internal step-down power supply circuit of the present invention.

FIG. 8 is a circuit diagram showing an internal step-down power supply circuit according to an eighth embodiment of the present invention. Incidentally, the same components as those in FIG. 7 are respectively identified by the same reference numerals and the description thereof will therefore be omitted.

The eighth embodiment is configured under the assumption that when it is desired to change a step-down power-supply voltage to an external power-supply voltage VDD upon testing, on-burn in voltage switching for screening an initial failure or defect, for example, is performed. The eighth embodiment is an example in which the divider circuit 161 according to the seventh embodiment is modified to provide a divider circuit 162. Since others are identical to FIG. 7 except for the divider circuit 162, the configuration of the divider circuit 162 will be explained.

A signal TST80 is a control signal for switching the step-down power-supply voltage to an external power-supply voltage VD. The signal TST80 is "L" upon a normal operation and "H" upon testing.

In the divider circuit 162, one electrode of an NMOS N88 is electrically connected to a node N14, the other electrode thereof is electrically connected to a ground potential GND, and a gate electrode thereof is supplied with the control signal TST80, respectively.

The operation of the eighth embodiment of the present invention will be explained using FIG. 8 from only a viewpoint at test mode switching different from the seventh embodiment.

When the signal TST80 is "L", the operation of the eighth embodiment is identical to the operations described up to the seventh embodiment. Upon the normal operation as described above, the step-down power-supply voltage is a voltage such as 1.5×Vf or 2×Vf, which is determined by a selected division ratio setting element group.

When the operation enters a test mode, the signal TST80 is rendered "H". Thus, the NMOS N88 of the divider circuit 162 is turned ON. If an ON resistance of the NMOS N88 is set to a magnitude negligible with respect to an ON resistance of the division ratio setting element group, then the node N14 is brought to the ground potential GND. Since an NMOS N11 and PMOSs P10 and P11 are held OFF and NMOSs N10 and N22 are held ON in this case, the gate of a PMOS P04 is also supplied with the ground potential GND, and the step-down power-supply voltage is electrically connected to the external power-supply voltage VDD by the PMOS P04 at low impedance.

According to the eighth embodiment of the present invention as described above, since the step-down power-supply voltage can easily be switched to the external power-supply voltage VDD by using the test mode, the external power-supply voltage VDD can easily be supplied as the step-down power-supply voltage by only the addition of one signal and the addition of one transistor to the divider circuit. Further, since the external power-supply voltage VDD and a step-down power-supply voltage output node are connected at low impedance, the external power-supply voltage VDD can reliably be supplied.

Figure 9:
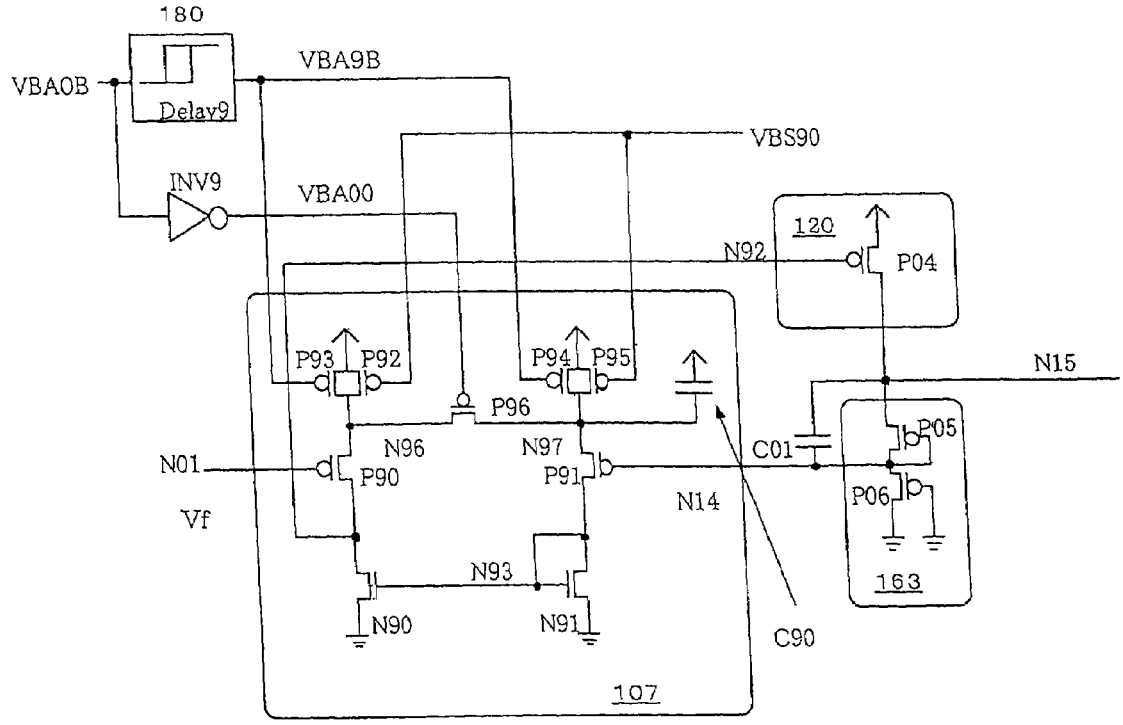
FIG. 9 is a circuit diagram illustrating a ninth embodiment of an internal step-down power supply circuit of the present invention.

FIG. 9 is a circuit diagram showing an internal step-down power supply circuit according to a ninth embodiment of the present invention. The present embodiment is provided as an embodiment which takes into consideration where it is desired to obtain a relatively high voltage as a step-down power-supply voltage and wherein the reference voltage Vf is taken as the gate voltage of the PMOS with the fourth embodiment as the base. Thus, only a configuration of a different amplifier 107 modified from FIG. 8 and a divider circuit 163 will be described. As to a control signal, another signal name is given to each of signals identical in purpose but different in state from the relationship in which gate control of NMOS is changed to gate control of PMOS. An inverter INV9 receives signal VBA0B that is "H" upon standby and receives therein a signal VBA0B that is "L" upon activation, and outputs a phase-inverted signal VBA00 thereof. A signal VBA9B is a signal which is responsive to the transition of the signal VBA0B from "L" to "H" upon transition from an active state to a standby state and which is brought to "H" with a delay equivalent to a time at which a circuit connected to the step-down power-supply voltage is completely brought into non-activation. When this is taken in reverse, no delay occurs. The signal VBS90 has a constant voltage in the neighborhood of VDD−Vtp (threshold value of PMOS) at all times.

In the differential amplifier 107, one electrode of a PMOS P93 is electrically connected to an external source or power supply VDD, the other electrode thereof is electrically connected to a node N96, and a gate electrode thereof is supplied with the signal VBA9B, respectively. One electrode of a PMOS P92 is electrically connected to the external power supply VDD, the other electrode thereof is electrically connected to the node N96, and a gate electrode thereof is supplied with a signal VBS90, respectively. One electrode of a PMOS P94 is electrically connected to the external power supply VDD, the other electrode thereof is electrically connected to a node N97, and a gate electrode thereof is supplied with the signal VBA9B, respectively. One electrode of a PMOS P95 is electrically connected to the external power supply VDD, the other electrode thereof is electrically connected to the node N97, and a gate electrode thereof is supplied with the signal VBS90, respectively. One electrode of a PMOS P96 is electrically connected to the external power supply VDD, the other electrode thereof is electrically connected to the node N97, and a gate electrode thereof is supplied with the signal VBA00, respectively. One electrode of a PMOS P90 is electrically connected to the node N96, the other electrode thereof is electrically connected to a node N92, and a gate electrode thereof is electrically connected to a node N01 (reference voltage Vf), respectively. One electrode of a PMOS P91 is electrically connected to the node N97, the other electrode thereof is electrically connected to a node N93, and a gate electrode thereof is electrically connected to a node N14 (internal step-down power-supply output node), respectively. One electrode of an NMOS N90 is electrically connected to the node N92, the other electrode thereof is electrically connected to a ground potential GND, and a gate electrode thereof is electrically connected to the node N93, respectively. One electrode of an NMOS N91 is electrically connected to the node N93, the other electrode thereof is electrically connected to the ground potential GND, and a gate electrode thereof is electrically connected to the node N93, respectively. A stabilizing capacitor C90 is electrically connected between the external power supply VDD and the node N97.

In the divider circuit 163, one electrode of the PMOS P05 is electrically connected to a node N15, and the other electrode thereof and a gate electrode thereof are electrically connected to the node N14. One electrode of a PMOS P06 is electrically connected to the node N14, and the other electrode thereof and a gate electrode thereof are electrically connected to the ground potential GND.

Since the embodiment shown in FIG. 9 is perfectly identical in operation to the fourth embodiment, the description thereof will be omitted.

The diode-connection of the PMOS P05 in the divider circuit 163 means that the potential at the node N14 is reliably set to VDD−Vtp or less, and the differential amplifier 107 is guaranteed in operation within a wide VDD voltage range.

According to the ninth embodiment of the present invention as described above, since the voltages inputted to both the nodes N01 and N14 are received at the PMOS gates, a relatively high voltage can be supplied as the step-down power-supply voltage.

The capacitors used through the first through ninth embodiments may be implemented using any of MOS capacitors for NMOS, PMOS, etc., a Poly-Poly capacitor, etc. While the transistors have been described with MOS as an example, a circuit may comprise bipolar transistors.

Except for the description in the embodiments, no particular restriction is imposed on a delay time of a delay circuit.

The method of generating the control signal for the differential amplifier, and producing the divider circuit is not limited to one described in the embodiments either. While PMOSs have been used as the resistive elements in the embodiments, resistive elements each formed of a diffused layer or Poly, for example, may be used. While the load MOS for the differential amplifier makes use of PMOS, any one may be used if means for implementing a constant current, for example, is utilized.

While the equalize transistor makes use of NMOS or PMOS, PMOS or NMOS may be used singly or PMOS and NMOS may be utilized in combination.

Finally, while the signal VBS00 has the predetermined low voltage, the external power-supply voltage VDD may be used.

According to the invention of the present application as described above in details, the drive capability of a driver can be enhanced with the same current consumption and exclusively-possessed area, it is possible to lighten a reduction in the potential of an internal power-supply voltage due to an instantaneous current of a internal power-supply voltage slave circuit.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. An internal step-down power supply circuit, comprising:

an internal step-down power-supply output node that provides an internal step-down power supply potential;

a driver that adjusts an external power-supply potential and provides an adjusted potential to the output node;

a divider that divides a voltage that appears on the output node and provides a divided voltage therefrom; and a differential amplifier connected to the divider, the differential amplifier having a first transistor that provides a current responsive to a reference voltage, a second transistor that provides a current responsive to the divided voltage provided from the divider, a third transistor providing a first electrical current from the external power-supply potential to the first transistor, and a fourth transistor providing a second electrical current from the external power-supply potential to the second transistor, the differential amplifier comparing the divided voltage provided by the divider and the reference voltage, wherein a conductance of the first transistor is set to n times a conductance of the second transistor, wherein n is greater than 1 and wherein a conductance of the third transistor is set to n times a conductance of the fourth transistor.

2. The internal step-down power supply circuit according to claim 1, wherein the driver comprises a PMOS transistor having a source connected to an external power supply, a drain connected to the internal step-down power-supply output node, and a gate connected to an output of the differential amplifier.

3. The internal step-down power supply circuit according to claim 1, further comprising a speed-up capacitor connected between the internal step-down power-supply output node and an output of the divider.

4. The internal step-down power supply circuit according to claim 1, wherein the third and fourth transistors are PMOS transistors, and the first and second transistors are NMOS transistors, the differential amplifier further comprising a circuit that connects the NMOS transistors to a ground potential.

5. The internal step-down power supply circuit according to claim 1, wherein the first and second transistors are respectively connected to a ground potential independently.

6. The internal step-down power supply circuit according to claim 5, wherein the second transistor is connected to a stabilizing capacitor that is connected between the second transistor and the ground potential.

7. The internal step-down power supply circuit according to claim 1, wherein the first and second transistors are connected to each other by an equalizing transistor.

8. The internal step-down power supply circuit according to claim 7, wherein the equalizing transistor is brought to an ON state only during a standby state.

9. The internal step-down power supply circuit according to claim 1, wherein a division ratio of the divider changes according to a control signal.

10. The internal step-down power supply circuit according to claim 4, wherein the circuit that connects the NMOS transistors to the ground potential is brought to a state of being capable of providing only a small current during standby and providing a sufficient current when active.

11. The internal step-down power supply circuit according to claim 4, wherein the circuit that connects the NMOS transistors to the ground potential is delayed upon transition from an active state to a standby state so as to provide a small current alone.

12. A step-down power supply circuit comprising:

an output node that provides a step-down power supply potential;

a driver connected to the output node, the driver providing an electric current from an external power-supply potential source to the output node in accordance with an adjustment signal received thereto;

a divider connected to the output node, the divider dividing a voltage that appears on the output node and providing a divided voltage; and a differential amplifier connected to the driver and the divider, the differential amplifier comparing the divided voltage with a reference voltage and providing the adjustment signal in accordance with the comparison, the differential amplifier including a first transistor having a first conductance, the first transistor providing a current in response to the divided voltage, a second transistor having a second conductance that is n times the first conductance, the second transistor providing a current in response to the reference voltage, wherein n is greater than 1, a third transistor through which a first electric current flows, and a fourth transistor through which a second electric current flows that is larger than the first electric current, wherein the differential amplifier is in a standby mode when the first electric current flows and is in an operation mode when the second electric current flows.

13. The step-down power supply circuit according to claim 12, further comprising a speed-up capacitor connected between the output node and an output of the divider.

14. The step-down power supply circuit according to claim 12, wherein the differential amplifier circuit further includes an equalizer circuit connected between the first and second transistors.

15. A step-down power supply circuit, comprising:

an output node providing a step-down power supply potential;

a driver connected to the output node, the driver providing an electric current from an external power-supply potential source to the output node in accordance with an adjustment signal received thereto;

a divider node;

a divider connected to the output node and the divider node, the divider providing a first voltage to the output node and a second voltage to the divider node; and a differential amplifier connected to the driver and the divider node, the differential amplifier comparing the second voltage with a reference voltage and generating the adjustment signal in accordance with the comparison, the differential amplifier including a first circuit having a first conductance connected to the divider node, a second circuit having a second conductance that is n times the first conductance and that is connected to the reference voltage, a first current circuit connected to the first and second circuits that provides a standby current to the first and second circuits so that the differential amplifier is in a standby mode, and a second current circuit connected to the first and second circuits that provides an operational current that is larger than the standby current to the first and second circuits so that the differential amplifier is in an operational mode, wherein n is greater than 1.

16. The step-down power supply circuit according to claim 15, further comprising a speed-up capacitor connected between the output node and an output of the divider.

17. The step-down power supply circuit according to claim 15, wherein the first current circuit operates normally and the second current circuit operates in response to an operation signal.

18. The step-down power supply circuit according to claim 15, wherein the differential amplifier further includes an equalizer circuit connected between the first and second circuits.

19. The step-down power supply circuit according to claim 18, wherein the equalizer circuit operates in response to an operational signal.

* * * * *